US007140138B1

(12) United States Patent
Laney et al.

(10) Patent No.: US 7,140,138 B1
(45) Date of Patent: Nov. 28, 2006

(54) FIREARM HAMMER WITH ADJUSTABLE SPUR

(75) Inventors: Mark C. Laney, Lee, NH (US); Gordon R. Cate, Stratham, NH (US)

(73) Assignee: Thompson Center Arms Company Inc., Rochester, NH (US)

( * ) Notice: Subject to any disclaimer, the term of this patent is extended or adjusted under 35 U.S.C. 154(b) by 0 days.

(21) Appl. No.: 11/248,439

(22) Filed: Oct. 11, 2005

(51) Int. Cl.
*F41A 3/00* (2006.01)

(52) U.S. Cl. ..... 42/69.03; 42/70.08

(58) Field of Classification Search ..... 42/69.03, 42/70.08

See application file for complete search history.

(56) References Cited

U.S. PATENT DOCUMENTS 4,122,622 A * 10/1978 Angelino ..... 42/65
4,833,809 A * 5/1989 Domian et al. ..... 42/65
5,335,437 A * 8/1994 Andersen ..... 42/70.08
6,862,830 B1 * 3/2005 Pagnoncelli ..... 42/70.08

OTHER PUBLICATIONS

Marlin Firearms Website: www.marlinfirearms.com dated Mar. 23, 2004 verified on www.archive.org□□Link to the Model 336W rifle.*

* cited by examiner

*Primary Examiner*—Michael J. Carone
*Assistant Examiner*—Benjamin Paul Lee
(74) *Attorney, Agent, or Firm*—Langlotz Patent Works, Inc.; Bennet Langlotz

(57) ABSTRACT

A firearm hammer has a hammer body with a hammer pivot axis for attachment to a firearm frame. A spur is connected to the hammer body, and the spur is movable among a number of positions with respect to the hammer body. The spur may be attached in a standard position in which it extends within the medial plane of the hammer body for use without a scope, or offset positions in which it angles away from the medial plane to provide accessibility. The offset angle may be 45 degrees, and a mating feature may provide the several attachment positions, each secure against movement except by deliberate removal of a fastener.

20 Claims, 4 Drawing Sheets

FIREARM HAMMER WITH ADJUSTABLE SPUR

FIELD OF THE INVENTION

This invention relates to firearms, and more particularly to hammers for firearms with telescopic sights.

BACKGROUND AND SUMMARY OF THE INVENTION

Many firearms including pistols, rifles, and specialized single shot firearms are hammer fired. The hammer is a pivoting element near the breech of the gun barrel that is drawn back against spring tension, then is released upon pulling the trigger. A forward face of the hammer pivots forward to strike the rear of a firing pin (or may itself including a firing pin) to strike the primer of a cartridge, or any ignition device used in muzzleloading firearms. The hammer typically has a spur, which is an extension that protrudes upward and/or rearward when the hammer is in the forward position, and which is engaged by the shooter's thumb to pull the hammer rearward to a coked position in preparation for the next shot. Some firearms such as single-action revolvers and certain single shot pistols and rifles, including standard breech-loaded firearms as well as muzzleloaders, require cocking for each shot, and other such as double action rifles and semiautomatic pistols operate to automatically cock the hammer by the action of pulling the trigger or by the cycle of action.

Telescopic sights such as rifle telescopes and pistols scopes may be mounted on a wide variety of firearms. It is desirable to mount a scope low, close to the bore of a gun's barrel. This provides a more compact form, and reduces inaccuracies due to the offset between the scope axis and the barrel axis. A low scope mounting position also allows a comfortable fit and eye relief for the shooter. However, in many applications, positioning the scope where desired may interfere with operation of the hammer. Normally, this does not necessarily mean that the scope blocks the path of the hammer spur, but that clearance is limited. This can make it difficult for the shooter to position his thumb above the spur as needed to cock the hammer. Depending on the clearance, the cocking operation may be difficult, painful, or impossible.

Accordingly, some firearms are provided with extension pieces that are bolted onto the spur, and which are essentially posts that extend laterally to the side of the spur, beyond the interfering scope. These may be attached to the left or right side of the spur, depending on the handedness of the shooter. Such existing extensions have several disadvantages. First, as an accessory piece, even an extension post included with the purchase of a firearm may be lost by the time the owner later acquires a scope for the firearm. More importantly, the perpendicularly protruding post is not only readily contacted by the shooter's thumb, but also by brush or other objects such as clothing to unintentionally cock the firearm. This creates a serious safety problem, because a hunter may wrongly assume that because he has not manually cocked his gun, it is safe for carrying about in the field, when in fact the gun has been unknowingly cocked by contact with brush and is ready to fire.

In addition, add-on pieces can cause a hammer spur to fracture due to the stresses during firing. Moreover, the added mass reduces the "lock time", which is the time it takes the hammer to fall through its path during firing, decreasing accuracy.

The present invention overcomes the limitations of the prior art by providing a firearm hammer having a hammer body with a hammer pivot axis for attachment to a firearm frame. A spur is connected to the hammer body, and the spur is movable among a number of positions with respect to the hammer body. The spur may be attached in a standard position in which it extends within the medial plane of the hammer body for use without a scope, or offset positions in which it angles away from the medial plane to provide accessibility. The offset angle may be 45 degrees, and a mating feature may provide the several attachment positions, each secure against movement except by deliberate removal of a fastener.

DETAILED DESCRIPTION OF A PREFERRED EMBODIMENT

Figure 1:
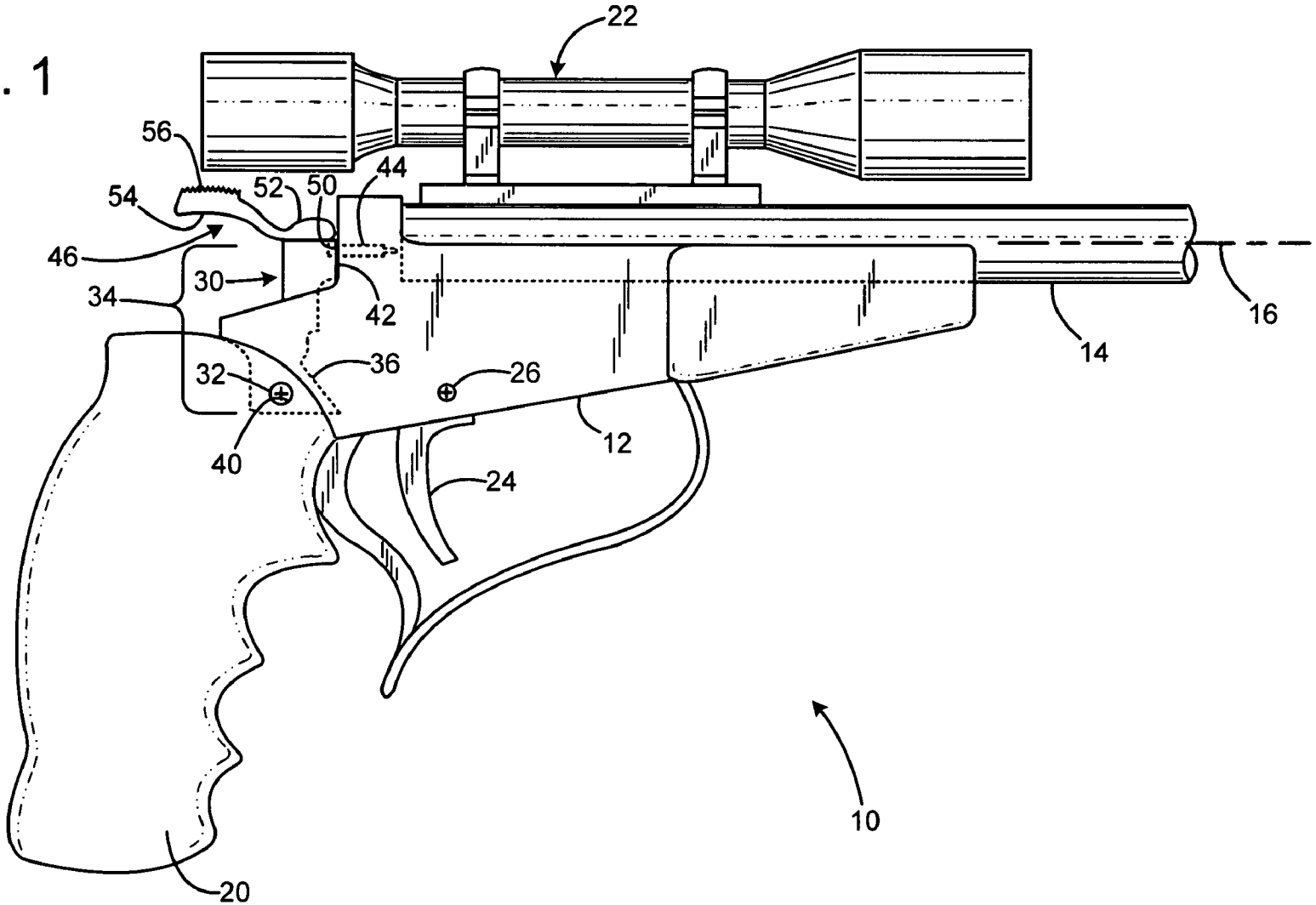
FIG. 1 is a side view of a firearm according to a preferred embodiment of the invention.

FIG. 1 shows a firearm 10 such as a single shot target or hunting pistol. The pistol includes a frame 12, a barrel 14 defining a barrel axis 16 and mounted to the frame, and a grip 20 mounted to the frame. A telescopic sight 22 is mounted to the barrel, with an optical axis essentially parallel to the barrel axis. A trigger lever 24 is pivotally attached to the frame for pivoting about a trigger axis 26 that is transverse to the frame, and perpendicular to the barrel axis. Similarly, a hammer assembly 30 is pivotally connected to the frame for pivoting about a hammer pin 32 that defines a hammer pivot axis. The hammer assembly is movable between a rear cocked position (not shown) and the forward uncocked or fired position shown. The hammer is biased to the fired position by the action of a spring (not shown).

The hammer assembly has a main body 34 including a lower portion 36 defining a pivot hole 40 for receiving the pivot pin. The hammer body 34 has a forward facing striking face 42 at an upper end. The face is positioned to align with and strike a firing pin 44 received in the frame and aligned with the barrel axis, and with the primer of a cartridge loaded into the breech of the barrel, or with an ignition device used in muzzleloading firearms.

The hammer assembly 30 includes a removable spur element 46, which is connected to an upper end surface 50 of the hammer body. The spur element includes a forward portion 52 removably secured to the hammer body, and a extending (rearwardly in the illustrated installation) spur 54. The spur has a knurled upper surface 56 so that it is readily gripped by the pad of a user's thumb for cocking the hammer.

Figure 3:
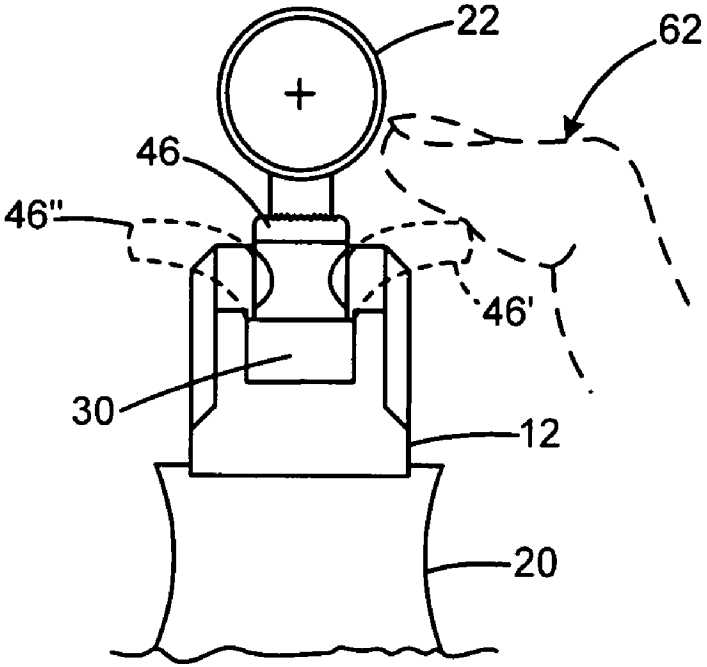
FIG. 3 is a rear end view of the embodiment of FIG. 1.
Figure 2:
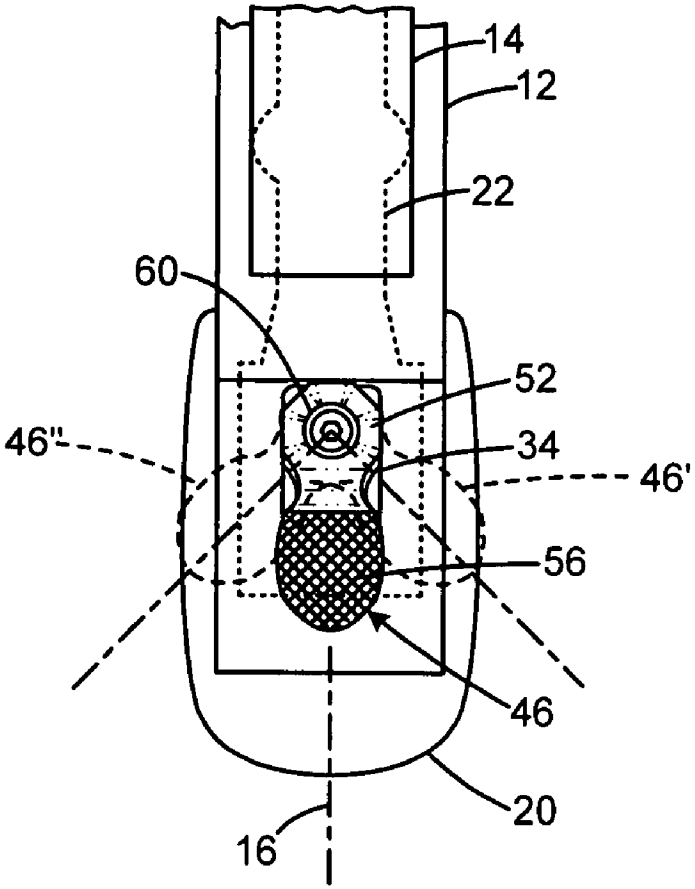
FIG. 2 is a fragmentary top view of the embodiment of FIG. 1.

As shown in FIGS. 2 and 3, the spur element 46 has three different positions. In position 46 shown in solid lines, it is aligned with the barrel axis 16, and extends rearward in the manner of a conventional hammer spur. This is used when no scope is attached, or when a scope is high, forward, or small enough not to interfere with hammer operation. In positions 46' and 46", its angled laterally by 45 degrees about a vertical axis defined by fastener 60, to the right (counterclockwise) or left (clockwise) respectively. The vertical axis is vertical when the hammer is in the forward position shown. In alternative embodiments, the offset angles may differ, and a different number of positions may be provided. In addition, a range of positions, including infinite adjustment within a range, may be provided.

The purpose of the selectable offset locations is to permit a user's thumb 62 (FIG. 3) to engage the knurled surface 56 of the spur when a scope 22 or other obstruction is mounted to the firearm. The availability of left and right offset angles from a single part without adding an accessory provides utility for both left and right handed users to select the desired configuration. The limited 45 degrees angle of offset provides that potential obstacles such as branches or clothing will tend to glance off or be guided away from the spur, without cocking the hammer. The fact that the adjustment is made without changing the mass of the hammer, and with minimal change to the moment of the hammer, means that stresses on the hammer during firing are not increased, and lock time is not meaningfully changed.

Figure 4:
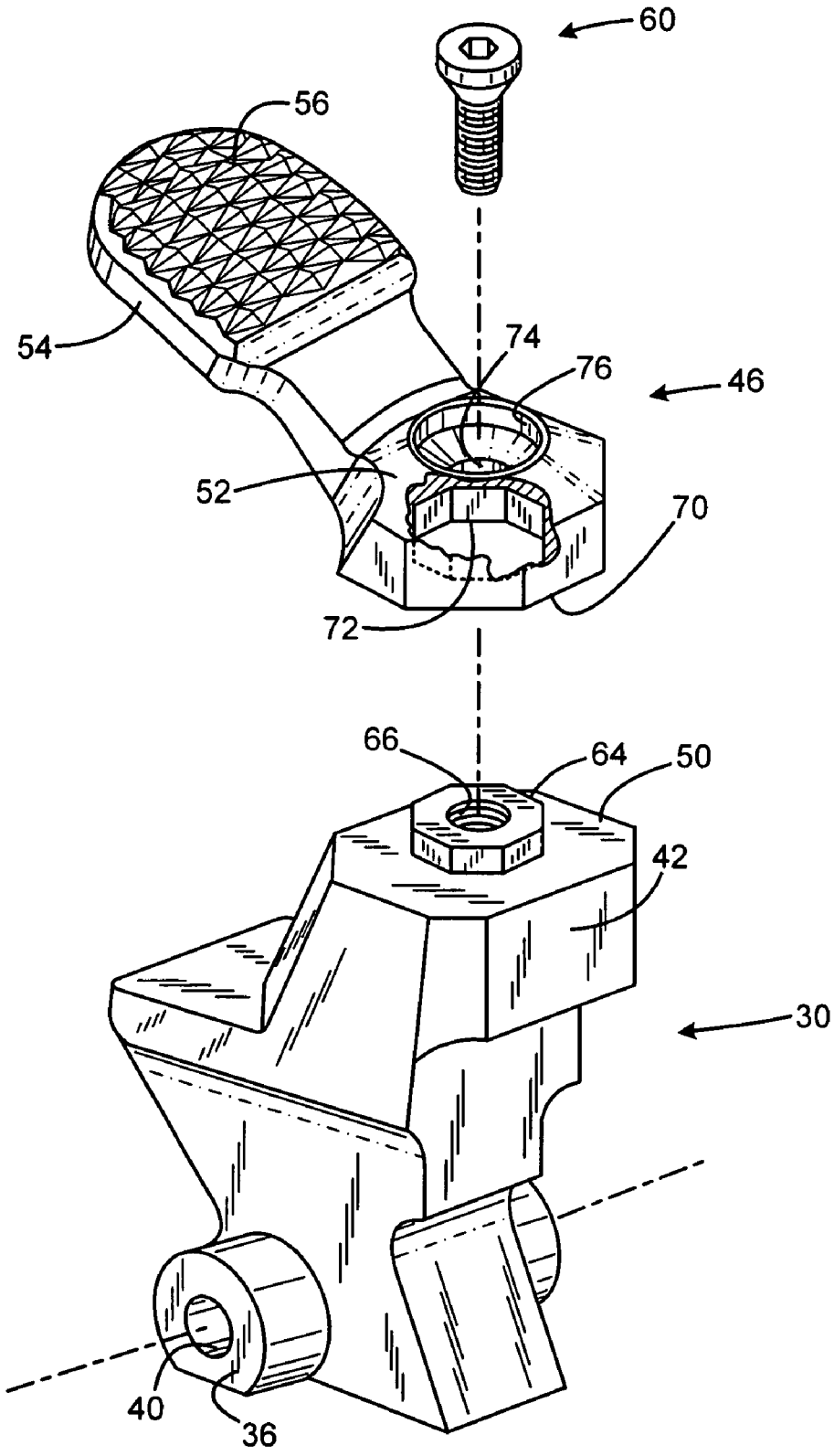
FIG. 4 is an enlarged exploded perspective view of the hammer assembly of the embodiment of FIG. 1.
Figure 5:
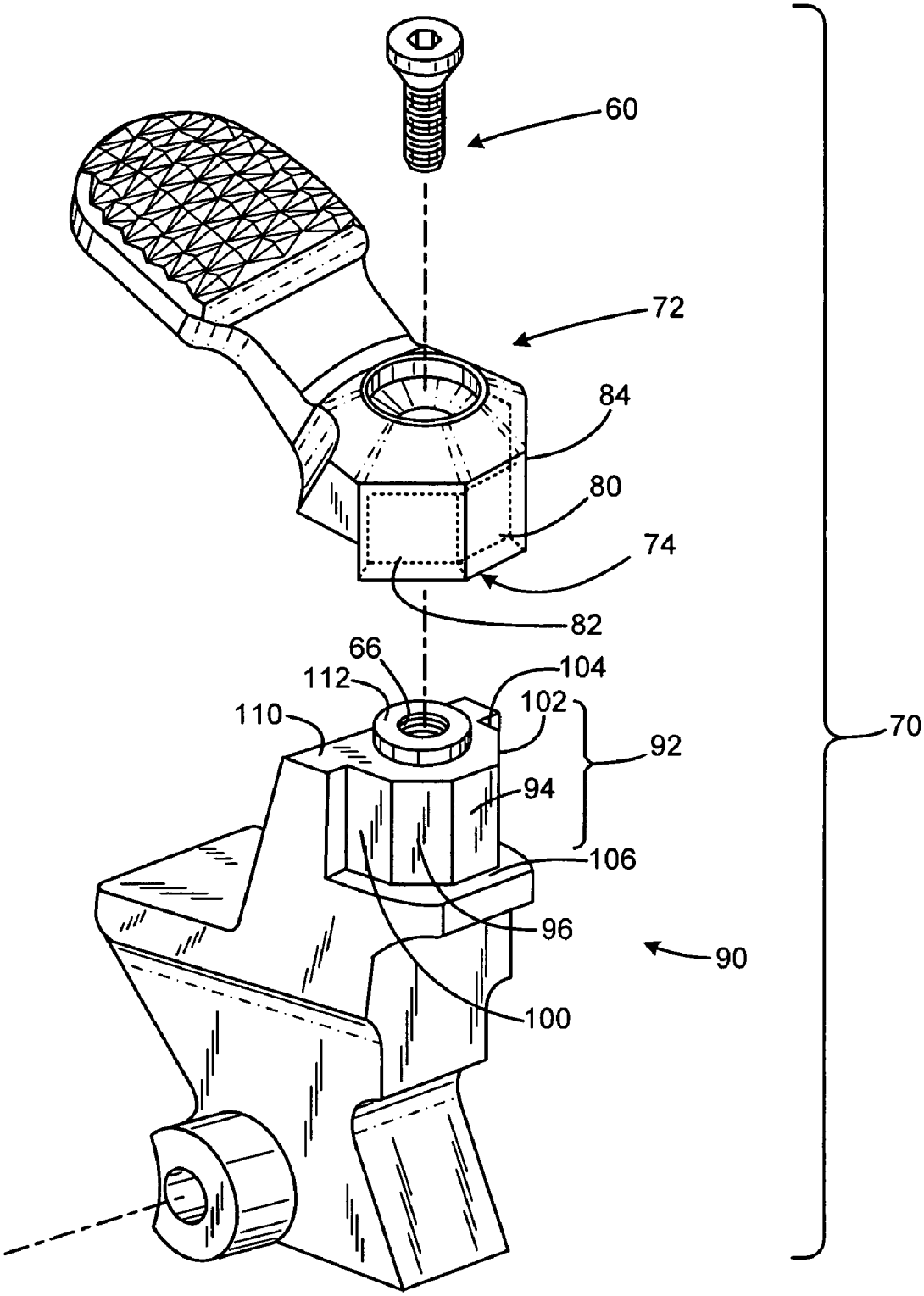
FIG. 5 is a perspective view of a hammer assembly according to an alternative embodiment of the invention.

As shown in FIG. 4. the upper surface 50 of the hammer body 30 includes an octagonal boss 64 that protrudes vertically from the surface, with all peripheral sides vertical. A vertical threaded bore 66 is provided centrally in the boss. The spur's forward end 52 has a lower surface 70 defining a socket 72 that has the same shape as the boss 64, and is sized to closely receive it in the manner that a socket wrench receives a nut or bolt head. Because the shape of the boss and socket (octagonal in the preferred embodiment to provide for the desired 45 degree offset options) are regular polygons, they may be mated at any of the several orientations. In an alternative embodiment such as illustrated in FIG. 5, the parts may be formed to prevent mating with a 90 degree offset, to prevent a user from installing the spur with a potentially dangerous 90 degree offset that is prone to accidental cocking by brush or clothing. The spur's forward portion 52 defines a clearance hole 74 with an enlarged upper portion 76 sized to receive the screw 60, which engages the threads of the hole 60 when installed.

In alternative embodiments, the mating elements need not be octagonal. For other angles, alternative polygons or other shapes may be selected. The shape need not be polygonal, as any regular lobed shape having several rotationally stable and secure positions will be suitable. This may include a serrated circle shape, or the like. The boss itself need not be the means for rotational position locking; a pin in one component and an array of holes in the other may provide multiple positions. For instance, a pin protruding downward from the lower surface of the spur element forward of hole 76 may engage one of several holes drilled at equal radii from the hole 66 (one forward of the hole 66, and one each right and left by 45 degrees in the preferred configuration).

In the preferred embodiment, the spur is secured against movement by the screw, so that inadvertent shifting of its angle is not possible. Deliberate use of tools is required. This is suitable because the lever position does not need to change, except when a scope is attached or removed, which is done rarely, and generally not in the field. However, an alternative embodiment may provide for more convenient shifting of the spur position, such as for sharing of the firearm by left and right handed users, or in a military context in which the handedness of the user will be unknown. Such an embodiment may employ a robust detent mechanism to prevent inadvertent shifting of the spur position, but to enable a shift upon deliberate application of force.

FIG. 5 shows an alternative hammer assembly 70 which has a safety feature that renders a firearm inoperable when the spur element 72 is removed. The spur element is the same as in the preferred embodiment, except that is has a downwardly-extending skirt 74 at the front portion. The skirt has three panels; a center panel 80 oriented vertically and facing forward, a right panel 82 oriented vertically and offset 45 degrees to the right from the center panel, and a left panel 84 oriented vertically and offset 45 degrees to the right from the center panel. The three panel' exposed surfaces essentially define three faces of an octagon, and the opposed surfaces facing the rear also define three sides of a smaller octagon.

The hammer body 90 is essentially as in the preferred embodiment, except for it's upper portion does not serve as a striker. The upper portion has a vertically extending support portion 92 that is at the level of the firing pin (not shown). However, the upper portion has a partial octagonal form having surfaces sized to closely fit with the rear surfaces of the spur element skirt 74. The octagonal form has a front surface 94, right-front surface 96, right surface 100, left front surface 102, and left surface 104. These five surfaces are oriented vertically, and have the profile of five sides of an octagon, each angled 45 degrees from the adjacent surfaces.

The five surfaces are recessed away from the edges of the hammer body, and most importantly, the front surface 94 is recessed from the plane of a front hammer body surface 106, which is below the level of a firing pin. Thus, the hammer body alone is incapable of striking a firing pin. A rear support buttress 110 is positioned to the rear of the octagonal form, and provides structural support against the forces of firing.

Atop the octagonal form is a cylindrical boss 112 defining the threaded bore 66. It closely mates with a cylindrical recess in the lower surface of the forward portion of the spur element, providing alignment and resistance to dislocation when the spur element is installed, prior to insertion and securing of the screw 60.

The spur element may be installed in the three different positions as in the preferred embodiment, to provide the desired spur position. Depending on the position, whichever of the faces 80, 82, 84 faces forward serves as the hammer face for striking the firing pin. When the spur is removed, such as for storage, or for when theft or misuse is a concern, the hammer body is incapable of discharging the firearm, provide a safety option advantage.

While the above is discussed in terms of preferred and alternative embodiments, the invention is not intended to be so limited.

The invention claimed is:

1. A firearm comprising:

a frame;

a barrel connected to the frame and defining a barrel axis;

the frame defining a transverse hammer pivot axis perpendicular to the barrel axis;

a hammer having a hammer body operably connected to the frame to provide about the hammer pivot axis;

the hammer having a spur connected to the hammer body; and the spur being movable among a plurality of positions with respect to the hammer body; and wherein the end portion of the spur is movable between a first position in which the end portion is aligned with a vertical medial plane defined by the barrel axis, and at least a second position in which the end portion of the spur is laterally offset from the medial plane in a first lateral direction.

2. The firearm of claim 1 wherein the spur is pivotally connected to the hammer body for rotation about a spur axis, the spur axis being angularly offset from the hammer pivot axis.

3. The firearm of claim 1 wherein the spur is movable to a third position in which the end portion of the spur is laterally offset from the medial plane in a second lateral direction opposite the first lateral direction.

4. The firearm of claim 1 wherein the first and second positions are angularly offset by 45 degrees.

5. The firearm of claim 1 wherein the spur is secured to the hammer body by a fastener, and wherein the spur is prevented from pivoting when the fastener is secured, such that the fastener must be deliberately removed to move the spur to another position.

6. The firearm of claim 1 wherein the hammer body defines a polygonal feature, and the spur defines a corresponding matable polygonal feature, such that the spur may be connected to the hammer body with the polygonal feature mated, in a plurality of different orientations.

7. The firearm of claim 1 wherein the hammer body defines a key feature having a profile with a rotational symmetry providing the same configuration in a plurality of different orientations, and the spur defines a corresponding matable key feature, such that the spur may be connected to the hammer body with the key features mated, in a plurality of different orientations.

8. The firearm of claim 1 wherein the spur includes a striking face positioned to strike a firing pin of the firearm, and the hammer body is spaced apart from the firing pin, such that removal of the spur renders the firearm unable to be fired.

9. A hammer for a firearm having a barrel axis:

a hammer body defining a hammer pivot axis adapted for pivotal attachment to a firearm frame;

a spur connected to the hammer body; and the spur being movable among a plurality of positions with respect to the hammer body; and having a second portion wherein the second portion is movable between a first position in which it is aligned with a vertical medial plane defined by the barrel axis, and at least a second portion in which the second portion of the spur is laterally offset from the medial plane in a first lateral direction.

10. The hammer of claim 9, wherein the spur is pivotally connected to the hammer body.

11. The hammer of claim 9 wherein the spur is movable to a third position in which the end portion of the spur is laterally offset from the medial plane in a second lateral direction opposite the first lateral direction.

12. The hammer of claim 9 wherein the first and second positions are angularly offset by 45 degrees.

13. The hammer of claim 9 wherein the spur is secured to the hammer body by a fastener, and wherein the spur is prevented from pivoting when the fastener is secured, such that the fastener must be deliberately removed to move the spur to another position.

14. The hammer of claim 9 wherein the hammer body defines a polygonal feature, and the spur defines a corresponding matable polygonal feature, such that the spur may be connected to the hammer body with the polygonal features mated, in a plurality of different orientations.

15. The hammer of claim 9 wherein the hammer body defines a key feature having a profile with a rotational symmetry providing the same configuration in a plurality of different orientations, and the spur defines a corresponding matable key feature, such that the spur may be connected to the hammer body with the key feature mated, in a plurality of different orientations.

16. The hammer of claim 15 wherein the key feature is an octagon.

17. A hammer for a firearm having a barrel axis:

a hammer body defining a hammer pivot axis adapted for pivotal attachment to a firearm frame;

a spur removably connected to the hammer body; and the spur having an attachment feature providing a plurality of different attachment positions with respect to the hammer body;

and having a second portion wherein the second portion is movable between a first position in which it is aligned with a vertical medial plane defined by the barrel axis, and at least a second position in which the second portion of the spur is laterally offset from the medial plane in a first lateral direction.

18. The hammer of claim 17 wherein the hammer body defines a medial plane perpendicular to the pivot axis, and wherein at least one of the attachment positions is angularly offset from the medial plane.

19. A firearm comprising:

a frame;

a barrel connected to the frame and defining a barrel axis;

the frame defining a transverse hammer pivot axis perpendicular to the barrel axis;

a hammer having a hammer body operably connected to the frame to pivot about the hammer pivot axis;

the hammer having a spur connected to the hammer body;

the spur being movable among a plurality of positions with respect to the hammer body;

wherein the spur is secured to the hammer body by a fastener; and wherein the spur is prevented from pivoting when the fastener is secured, such that the fastener must be deliberately removed to move the spur to another position.

20. A hammer for a firearm comprising:

a hammer body defining a hammer pivot axis adapted for pivotal attachment to a firearm frame;

a spur connected to the hammer body;

the spur being movable among a plurality of positions with respect to the hammer body;

wherein the spur is secured to the hammer body by a fastener; and wherein the spur is prevented from pivoting when the fastener is secured, such that the fastener must be deliberately removed to move the spur to another position.

* * * * *